US005303620A

United States Patent [19]

Payne et al.

[11] Patent Number: 5,303,620

[45] Date of Patent: Apr. 19, 1994

[54] SCREW GUN

[76] Inventors: Guy R. Payne, Box 509, Anson, Tex. 79501; Lorton E. Trent, 417 Crestover Cir., Richardson, Tex. 75080

[21] Appl. No.: 1,265

[22] Filed: Jan. 7, 1993

[51] Int. Cl.[5] ..... B25B 23/06

[52] U.S. Cl. ..... 81/434; 221/74; 206/345; 206/347

[58] Field of Search ..... 221/70, 71, 74; 81/57.37, 434; 206/230, 338, 345-347, 820

[56] References Cited

U.S. PATENT DOCUMENTS

| | | | |
|---|---|---|---|
| 4,018,334 | 4/1977 | Lejdegard | 206/347 |
| 4,378,065 | 3/1983 | Smirne | 221/70 X |
| 4,925,030 | 5/1990 | Ball | 206/345 X |
| 4,932,821 | 6/1990 | Steffen et al. | 206/347 X |
| 4,998,452 | 3/1991 | Blum | 81/57.37 |

FOREIGN PATENT DOCUMENTS

| | | | |
|---|---|---|---|
| 1934559 | 1/1970 | Fed. Rep. of Germany | 81/434 |

*Primary Examiner*—James G. Smith
*Attorney, Agent, or Firm*—Wendell Coffee

[57] ABSTRACT

A screw gun has a flat planar work face adapted to be placed flat against the work. An activator extending from the work face advances a screw along a guideway from a magazine to a driving position. A power unit is independently activated to drive the screw into the work. The screws in the magazine and guideway are mounted upon a flexible strip which has a body at the screw. The body has knobs extending on either side which fit within a groove of the guideway. The strip with the screws therein form a "Z" fold within the magazine and are guided from the magazine by a feed section which has one concave side and one convex side.

18 Claims, 5 Drawing Sheets

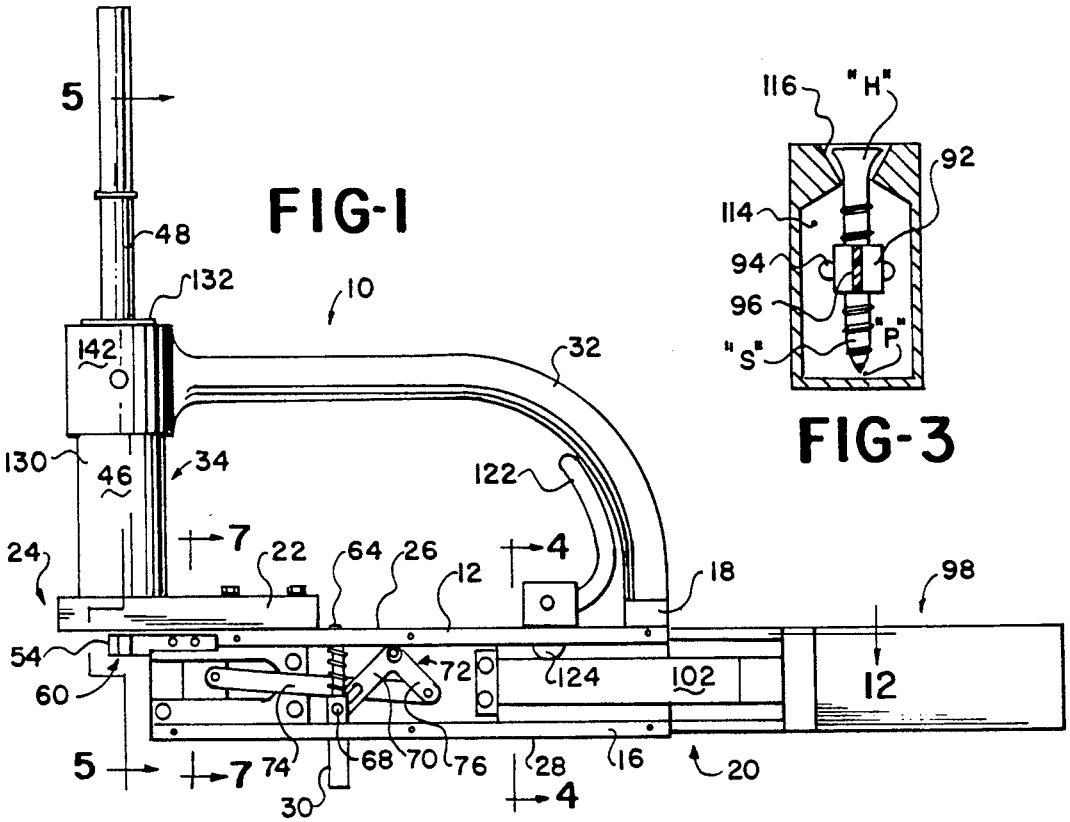
FIG-1
FIG-3
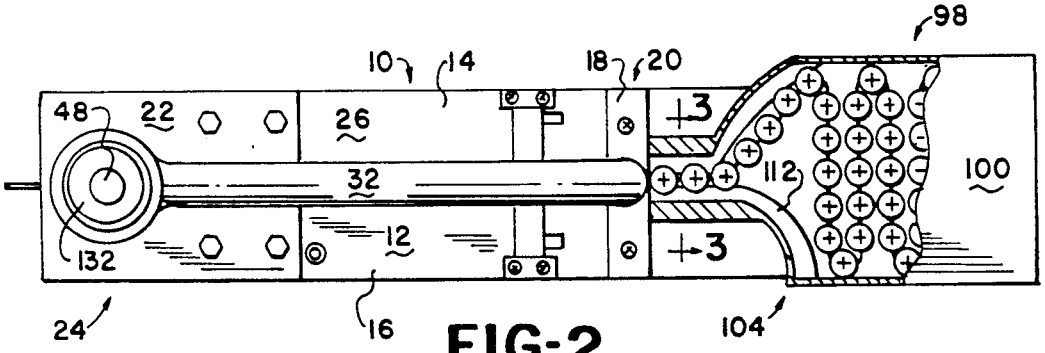
FIG-2
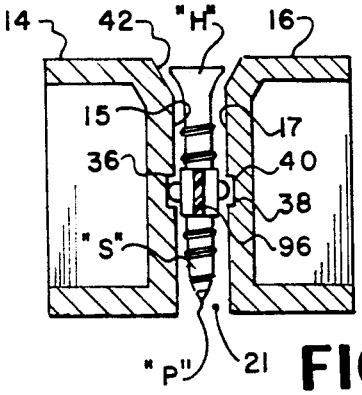
FIG-4
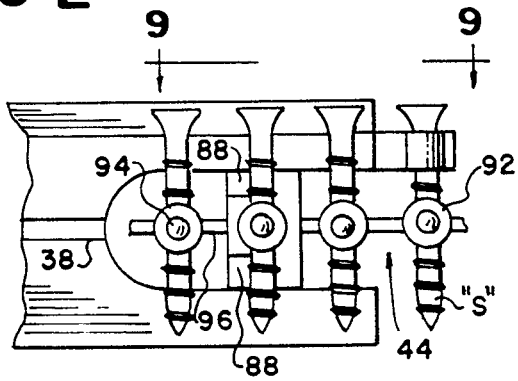
FIG-6

SCREW GUN

CROSS REFERENCE TO RELATED APPLICATION

None, however, Applicant filed Disclosure Document Number 315,777 on Aug. 21, 1992 which document concerns this application; therefore, by separate paper it is respectfully requested that the document be retained and acknowledgment thereof made by the Examiner. (MoPEP 1706)

BACKGROUND OF THE INVENTION (1) Field of the Invention

This invention relates to screw guns. Screw guns have been developed for use in modern manufacturing (CHEN, U.S. Pat. No. 5,138,913) and construction of structures (NASIATKA, U.S. Pat. No. 3,910,324 and CAST, U.S. Pat. No. 4,625,597). Basically a screw gun is adapted to hold a magazine of screws and automatically advance them to a driving position where they may be driven into the work by a power driven bit. Although this invention is adapted for use with self-tapping metal screws in manufacturing or wood screws in construction of wooden structures such as furniture or cabinets, it is particularly adapted for attaching gypsum wall boards for structures such as habitations or offices. The studs to which the wall board is attached may be either metal or wood.

A construction worker skilled in attaching wall board is one having ordinary skill in the art.

(2) Description of the Related Art

In addition to the three patents referenced above, applicant was aware of the following U. S. patents.

| | |
|---|---|
| MIZUNO et al | 4,404,877 |
| TAKAGI | 5,083,483 |
| FARIAN et al | 5,109,738 |
| HALSTEAD | 3,554,246 |
| DAMRATOWSKI | 3,971,421 |

All of these devices are characterized by having a small surface on the screw gun which contacts the work piece. In addition, most of the patents referenced above have the electric or air-driven motor integral with the gun.

Despite the developments as shown in the above identified patents, in common practice today, wall board is attached to studs by the workman holding the wall board against the stud with his shoulder or arm, holding a single screw between his fingers and driving the screw with an electric powered drill which has a screwdriver bit thereon. As an alternate to this, at times wood screws are held by a finger and driven by hammer partially into the wood and thereafter driven by a screwdriver.

SUMMARY OF THE INVENTION (1) Progressive Contribution to the Art

This application discloses a screw gun particularly adapted for the construction industry but also having general utility. It is characterized by a large planar work face to insure that hurried workmen will hold the gun flat against the work piece so that the screw is aligned normal or right angles to the work piece. In addition to this, it is designed that the feeding apparatus i.e., the gun is hand held separate from the electric-driven motor. This is for two purposes, first, inasmuch as normally in the construction trades the workmen own their own tools and most of the workmen will own a power-driven hand drill for other operations they perform in construction. Therefore, having the screw feed mechanism adapted to use a separate drill relieves the necessity for the workmen to buy another power unit making the equipment less expensive. Furthermore it is believed there are certain hazards for workmen having their hands and fingers in hazardous positions. Therefore, if for operation one hand is required for holding the feed mechanism and the other hand for operating the electric drill the hands and fingers cannot be in otherwise hazardous locations.

Furthermore by having a large planar work face this eliminates the necessity of having the feed mechanism extremely compact making it less expensive to manufacture, more reliable in operation and easier to repair, if necessary. Also, it is more versatile in that it is easier to adapt it to different diameters and lengths of screws.

(2) Objects of this Invention

An object of this invention is to drive screws quickly, safely, and precisely.

Further objects are to achieve the above with devices that are sturdy, durable, lightweight, simple, safe, efficient, versatile, ecologically compatible, energy conserving, and reliable, yet inexpensive and easy to manufacture, operate, and maintain.

Other objects are to achieve the above with a method that is rapid, versatile, ecologically compatible, energy conserving, efficient, and inexpensive, and does not require highly skilled people to operate, and maintain.

The specific nature of the invention, as well as other objects, uses, and advantages thereof, will clearly appear from the following description and from the accompanying drawings, the different views of which are not necessarily scale drawings.

BRIEF DESCRIPTION OF THE DRAWINGS

FIG. 1 is a side elevational view of a screw gun and magazine according to this invention with the cover removed.

FIG. 2 is a top plan view of a screw gun and magazine with a portion of the cover of the magazine shown broken for clarity.

FIG. 3 is a sectional view through the neck of the magazine taken substantially on line 3—3 of FIG. 2.

FIG. 4 is a sectional view through the base of the gun taken substantially on line 4—4 of FIG. 1.

FIG. 6 is a sectional view taken substantially on line 6 of FIG. 5 looking toward the pawl.

Figure 5:
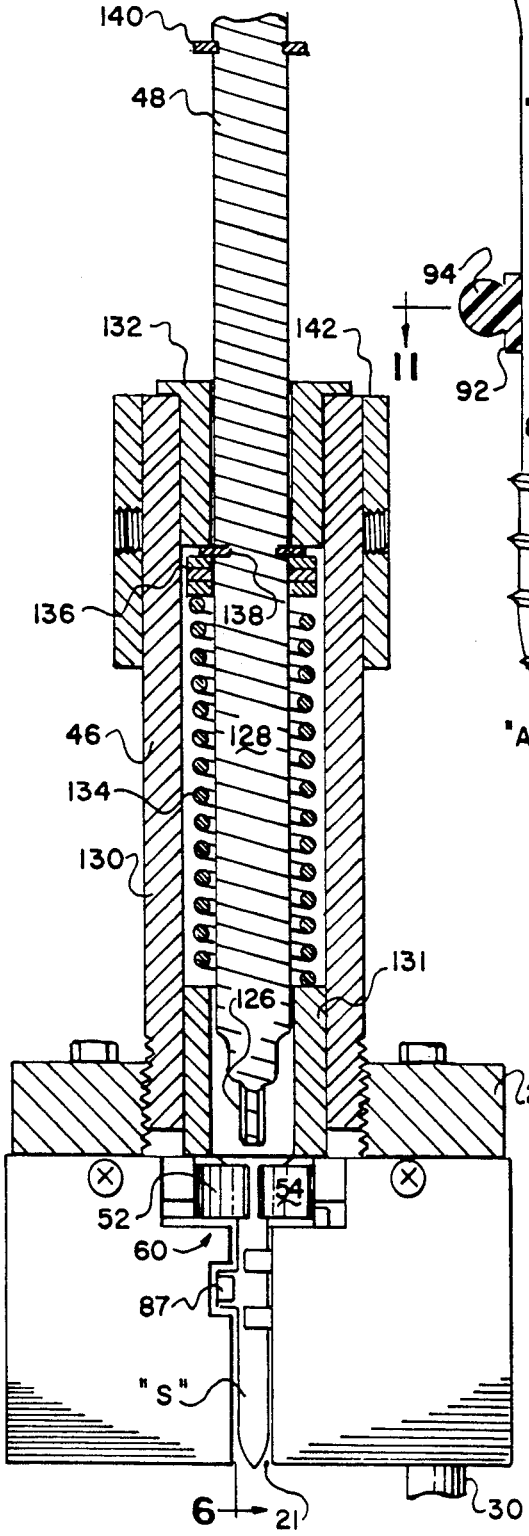
FIG. 5 is a sectional view through the drive bit looking toward the gun taken substantially on line 5—5 of FIG. 1.

As an aid to correlating the terms of the claims to the exemplary drawing(s), the following catalog of elements and steps is provided:

10—screw gun
12—base
14—channel, back
15—back web face
16—front channel
17—front web face
18—handle strap
20—feed end
21—guideway
22—driver strap
24-drive end
26—handle face
28—planar work face
30—actuator
32—handle
34—drive head
36—back groove
38—front groove
40—strip track
42—beveled
44—strip or chain
46—bit guide
48—bit
50—power unit
52—back spring clip
54—front spring clip
56—bands
58—cavity
60—screw holder
62—shoulder
64—guide
66—spring
68—finger
70—leg
72—bell crank
74—pitman
76—leg
78—carrier
80—carrier track
81—slotted retainer plate
82—working face
84—groove
86—pawl
87—latch
88—prongs
90—90 helical torsion spring
92—body
94—knob
96—link
97—load tab
98—magazine
100—box
102—neck
104—feed section
106—advance end
108—concave wall
110—convex wall
112—bevel
114—magazine guideway
116—bevel
118—neck advance
119—hole
120—top of neck
122—latch lever
124—latch cam
126—drive portion
128—shank
130—housing
131—bushing
132—bearing
134—bit spring
136—thrust bearing assembly
138—spring clip
140—screw stop
142—handle sleeve
S—Screws
H—Heads
P—Point

DESCRIPTION OF THE PREFERRED EMBODIMENTS

Referring to the drawing there may be seen screw gun 10 according to this invention. Base 12 of the gun includes two channel members which are identified as back channel 14 and front channel 16. The two channels are held with their web faces 15 and 17 in facing spaced apart relationship by handle strap 18 at feed end 20 of the base 12. Guideway 21 is formed between the web faces. The back and front channels 14 and 16 are held together by spacer block or driver strap 22 at driver end 24 of the base 12.

The channels 14 and 16 are attached together by the straps 18 and 22 on handle face 26 of the channels. Planar work face 28 is formed by the opposite flanges of the channels 14 and 16. As may be seen the planar work face 28 is smooth and flat, uninterrupted except for actuator 30 projecting through and beyond the planar work face 28. Handle 32 extends from the handle strap 18 to handle attachment or drive head 34 which is attached to the driver strap 22 at the drive end 24 of the base. The handle 32 is attached at the feed end to the handle strap 18 and at the drive end to the drive head 34 which in turn is connected to the channels 14 and 16. The handle face 26 and planar work face 28 are opposite one another on the base 12.

Groove 36 is formed in the back web face 15. (FIG. 4) Groove 38 corresponding to the groove 36 is formed in the front web face 17. These grooves form strip track 40 in the guideway 21 for the length of the base. The length of the base extends from the feed end to the drive end. The web faces 15 and 17 form the conduit or passage or duct or guideway 21 for the screws "S" to pass from the feed end 20 to the drive end 24. The corners both of the channels 14 and 16 at the handle face are beveled at 42 to form a guide or head track for guiding heads "H" of the screws "S". Each screw "S" will have a point "P" near the work face and a mid-point about halfway between the head and point.

Figure 10:
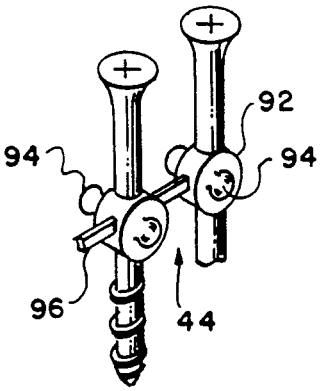
FIG. 10 is a perspective view of a portion of the screw chain, or strip.
Figure 11:
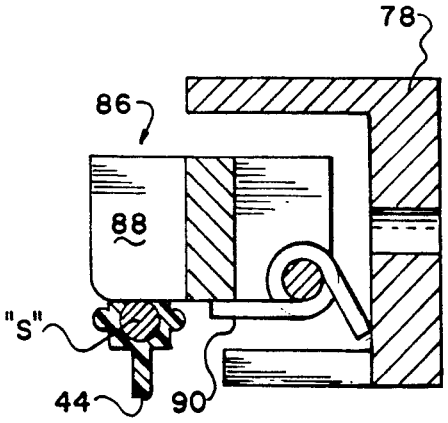
FIG. 11 is a sectional view of the pawl and portions of the carrier taken substantially on line 11—11 of FIG. 7.
Figure 12:
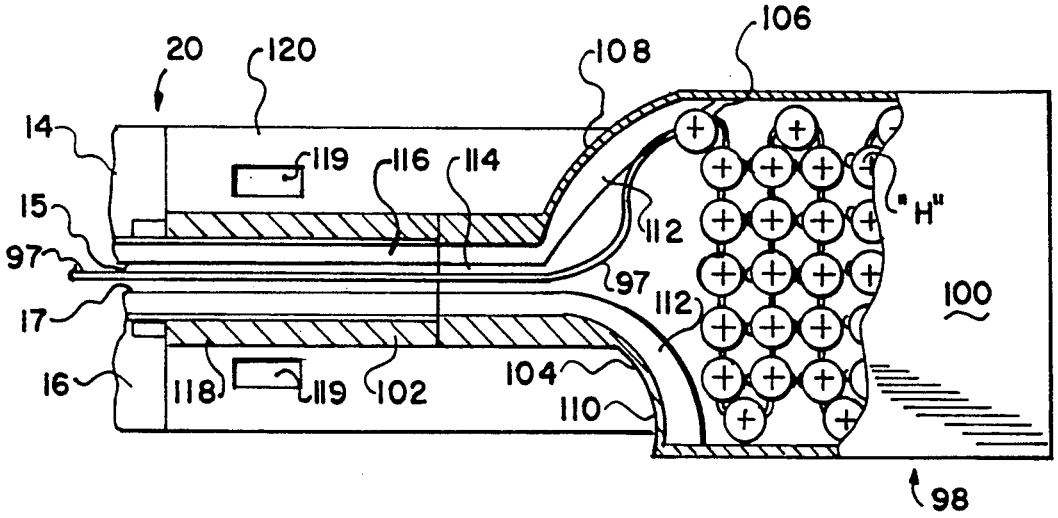
FIG. 12 is a sectional view taken substantially along line 12 of FIG. 1.
Figure 13:
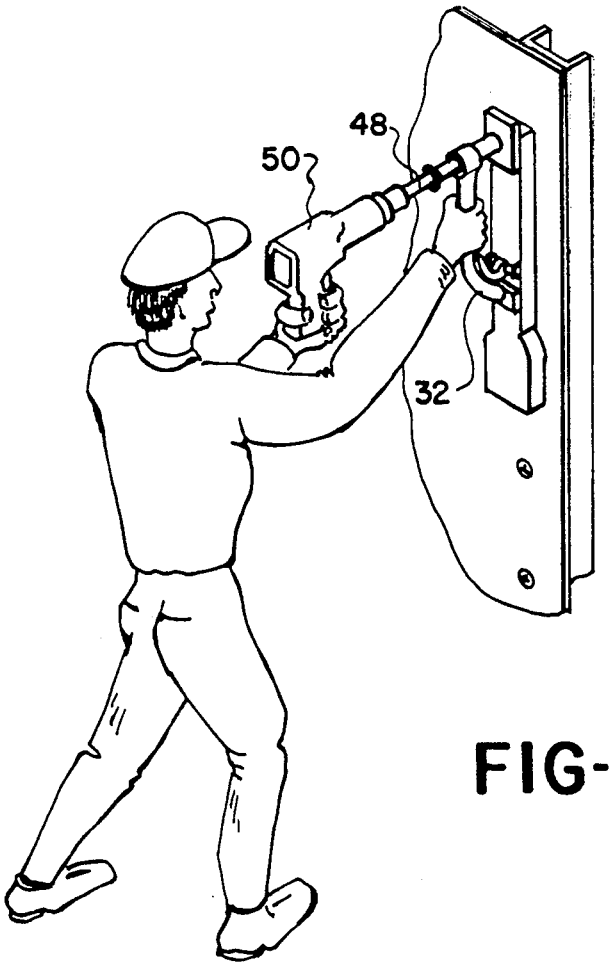
FIG. 13 is a perspective view somewhat schematic showing a man using the gun to attach a panel of wall board to a support.
Figure 14:
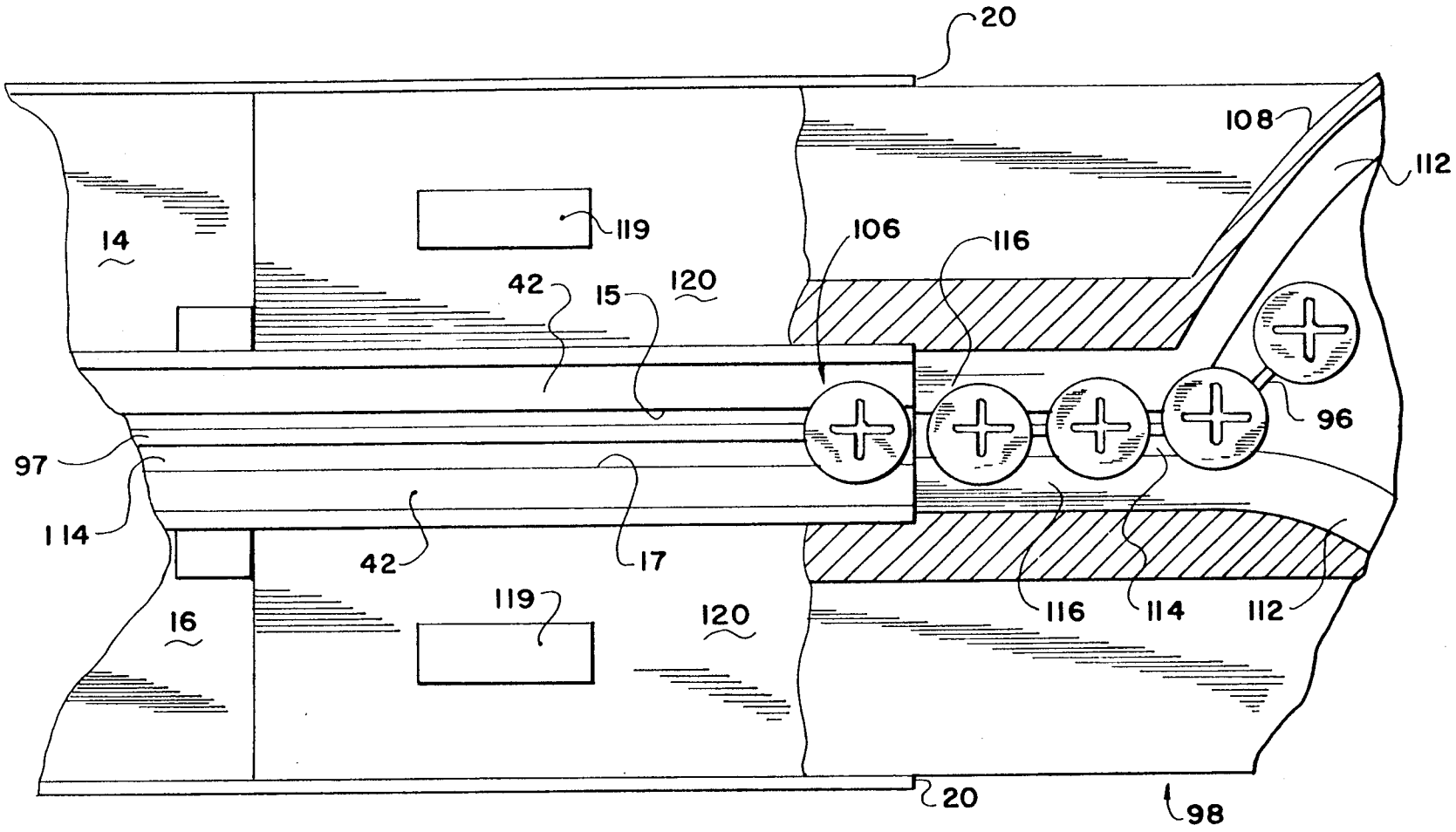
FIG. 14 is an enlarged top view of a portion of FIG 12 with a portion of the top 120 broken away.

The screws "S" are attached to flexible chain or strip 44. (FIG. 10) As described later, portions of the strip 44 will ride in track 40 formed by the grooves 36 and 38 so that a plurality of screws may be fed as a series through the guideway 21 with the head of the screws resting on the bevel 42 and therefore the heads of the screw will be proximate the handle face 26. The screws will be traverse to the planar work face 28, and preferably at right angles or normal to the planar work face.

The drive head 34 includes tubular bearing block or tube or bit guide 46. The bit guide 46 includes tubular bearing 132 at its top or distal end and bushing 131 at its base or proximal end. The tubular bit guide is adapted to receive bit 48 of a screw driver. The bit is particularly adapted to use the TORX bit which is a registered trademark of the TEXTRON Corp. and particularly of the TORX Driving System of the CHEM CORE division of Textron, Inc., Rockford, Ill. This TORX has a bit, a positive drive head thereon and is adapted to be used with a screw having a screw head with a positively driven splines therein. The screw driver includes power unit 50 attachable in driving relationship to the bit 48. The tubular bit guide is at right angles or normal to the planar work face 28.

Figure 9:
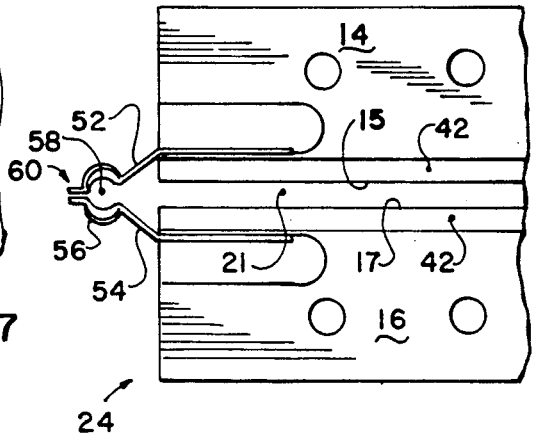
FIG. 9 is a top plan view of the screw holder taken substantially on line 9—9 of FIG. 6 without the screws.

Back spring clip 52 is attached to the back web 15 at the drive end 24 as seen in FIG. 9. The spring clip extends beyond the drive end 24. Mating front spring clip 54 is attached to the front web 17 at the drive end. The two clips 52 and 54 are a mated pair with each having concave bends 56 within them. These bends form cavity 58. The center of the cavity 58 is aligned with the axis of the tubular bit guide 46. As seen in the drawings the spring clips 52 and 54 form screw holder 60 which is adapted to receive one of the screws carried through the guideway 21. As seen in FIG. 9, the clips 52 and 59 have bevels corresponding to bevel 42.

Figure 7:
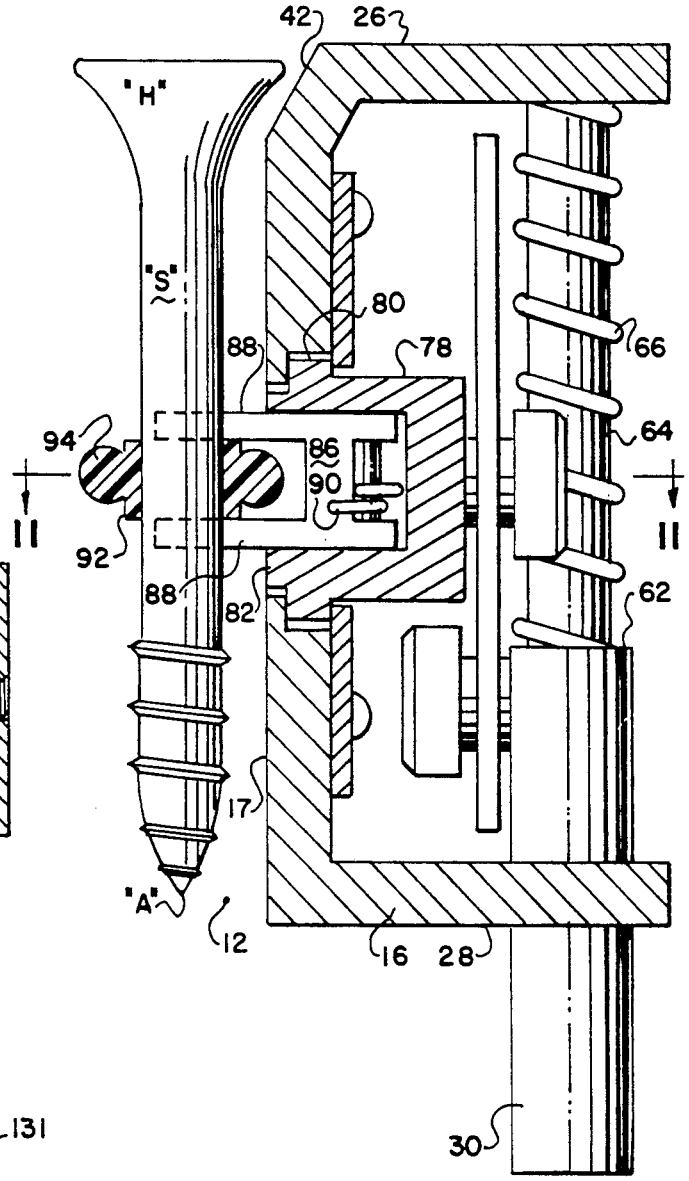
FIG. 7 is a section through the pawl and carrier taken substantially on line 7—7 of FIG. 1.
Figure 8:
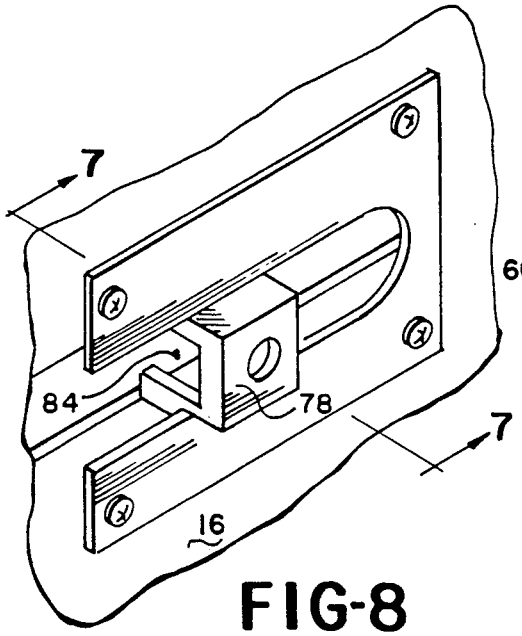
FIG. 8 is a perspective view of the pawl carrier with the slotted retainer plate.

Actuator 30 is in the form of a cylindrical plunger which extends through the flange of front channel 16 which forms a portion of the planar work face 28. (FIGS. 1 and 7) The actuator has shoulder 62 so that a cylindrical guide 64 aligned with the actuator extends upward and through the flange of the front channel 16 which forms the portion of the handle face 26. The actuator 30 and guide 64 are integral. Helical compression spring 66 extends between the shoulder 62 and the bottom of the handle face 26 around the guide 64 to bias the actuator away from the work face 28.

Finger 68 upon the actuator 30 extends through an elongated slot in leg 70 of bell crank 72. The bell crank is pivoted to the front channel 16. Pitman 74 is pivoted to leg 76 of the bell crank 72. The pitman 74 is also pivoted to carrier 78. The carrier is mounted upon carrier tracks 80 for movement aligned with the guideway 21 and the track 40. The carrier is kept on the carrier track by slotted retainer plate 81. Analysis shows when the screw gun is pressed against a work piece or other structure that the actuator will be depressed, the bell crank rotated to move the carrier toward the drive end 24 of the base 12. When the screw gun 10 is removed from structure which depresses the actuator 30 the spring 66 will force or bias the actuator away from the planar work face 28 and cause the bell crank to retract the carrier 78 from the drive end 24.

The carrier is mounted with working face 82 aligned with the front web face 17. The working face 82 of the carrier 78 has groove 84 aligned with the front groove 38. Therefore the strip 44 will follow the continuous strip track through the carrier 78.

Pawl 86 is pivoted to the carrier so that two prongs 88 project from the pawl, one prong on one side of the groove 84 and the other prong on the other side of groove 84. Helical torsion spring is attached to the carrier 78 to bias the two prongs 88 of the pawl into the guideway 21. The pawl is constructed and designed so that upon motion of the carrier 78 away from the drive end 24 the prongs may retract from the guideway 21 when the pawls encounter a screw "S" within the guideway. However, when the carrier 78 moves toward the drive end 24 the pawl 86 locks into an extended position so that the prongs push any screw they encounter in the guideway toward the drive end 24. Non-reverse latch 87 in groove 36 prevents the strip 44 and screws "S" from moving toward the feed end 20.

The flexible strip 44 includes body 92 around the mid-point of the screw. The height of the body along the length of the screw is greater than the width of the grooves 36 and 38. Projecting from each side of the body is knob 94. The knob is semi-spherical in shape. The knobs will ride within the track formed by the grooves 36 and 38. Pawl prongs 88 will push the screw "S" with one prong above the body 92 and one prong below the body. The screw holder 60 will hold the screw with the spring clips 52 and 54 between the body and the head. Each of the bodies 92 of the strip 94 are connected to adjacent bodies 92 by links 96. The link is a thin strip of flexible material connected from each body to the body 92 on the adjacent screw. Preferably the strip 44 is made in its entirety of a flexible synthetic material which is molded onto a series of screws by conventional means. As described, the strip will have the bodies connected by links and therefore their resemblance to a chain. Upon one end of the strip, thin flexible loading tab 97 is attached. The loading tab 97 will have a length which is longer than the length of the guideway 21.

Magazine 98 includes three elements: rectangular box 100, neck 102, and feed section 104, connecting the box to the neck. A full magazine will include a plurality of screws on the strip 44 in a "Z"-fold within the box section. Advance end 106 of the strip will be adjacent to the feeding section and the loading tab will extend through the feeding section and the neck. The box will have two sides. The feed section on one side will have concave wall 108. When full, the advance end 106 will be where the concave wall of the feed section meets one of the sides of the rectangular box 100. The wall on the other side of the feed section will be convex wall 110. Each of the concave and convex walls 108 and 110 will have a bevel 112 corresponding to the bevels 42 along the guideway 21.

It has been found that the strip 44 feeds from the "Z"-fold in a more satisfactory fashion with the feed section having the concave and convex portions as shown and described.

The neck includes magazine guideway 114. The magazine guideway also will have a head bevel 116 which corresponds to the bevels 42. With the magazine connected to the screw gun 10 the magazine guideway 114 will be aligned with the screw gun guideway 21 and the bevels 112 and 116 will form a continuous surface leading into the bevels 42. Advance portion 118 of the neck straddles the webs having the faces 15 and 17. Top surface 120 of the neck advance portion 118 has hole 119 on each side thereof. Latch lever 122 is pivoted to the handle face between the handle strap 18 and the driver strap 22. Latch cam 124 is connected to the latch lever 122 and projects below the flange of the handle face. Therefore it may be seen that when the magazine 98 is mated with the screw gun 10 that rotation of the latch lever 122 to the position shown in the drawings will pull the magazine neck advance 118 into snug position by the action of the latch cams 124 against the forward portion of the holes 119.

To attach a full magazine the loading tab 97 is pulled from the neck 102 and threaded through the guideway 21 until it extends from the drive end 24 of the gun. Then the magazine 98 is latched into position at the feed end 20 of the screw gun. Then the feeding tab is pulled forward until a screw "S" is pulled beyond the pawl prongs 88. By the term "passed the pawl prongs" it means so that the screw is between the pawl prongs 88 and the screw holder 60. At this point, when the work face is pressed against a work piece, the screw will be fed forward. If the screw is not yet in the screw holder, a second depression of the actuator 30 will complete the action.

As shown herein the bit 48 has been shown as a single integral member. It will be understood that driving portion 126 could be detachable from the remainder of the bit 48. The driving portion, of course, being that portion of the bit which has a positive drive head which fits the splines of the head "H" of the screw "S". Shank portion 128 of the bit extends upward through the bit guide 46. The bit guide is tubular having a tubular housing 130 which threads into the driver strap 22. The lower or proximal portion of housing 130 has bushing 131 telescoped therein which furnishes precision placement of the drive portion 126 with respect to the screw "S" within the screw holder 60.

The upper or distal portion of the housing 130 has tubular bearing 132 to position this portion of the shank 128. Bit spring 134 extends from the top of the bushing 131 to thrust bearing and washer assembly 136 which is telescoped around the bit 48 immediately below stop washer or spring clip 138. It may be seen that the stop washer is fitted into a groove in the bit 48 and the spring 134 biases it upward until it stops when the stop washer 138 rests against the bottom of the bearing 132. Therefore it may be seen that the normal position of the bit is away from the handle face of the base. However, engagement of a power driver 50 to the bit shank 128 can be pressed downward until the drive portion 126 engages the screw to screw it in.

Screw spring clip or spring clip 140 is placed in a groove in the bit shank above the bearing 132. The screw spring clip 138 is positioned so that when it engages the top of the bearing 132 this limits the downward movement of the drive portion. This point is selected so that the head "H" of the screw will be slightly below the work face 28 of the base 32. When in use this means that the head of the screw will be slightly below the work surface into which the screw is driven. Obviously, by provision of additional grooves or spacers between the top of the bearing 132 and the screw stop washer 140, the position of disengagement of the drive portion from the screw head "H" can be adjusted, thereby adjusting the depth of the screw.

Handle sleeve 142 is telescoped over the top of the housing 130. The handle 32 has the handle sleeve 142 integral with the forward portion of the handle. Set screws through the handle loop thread through the sleeve to fasten the handle to the bit guide 46. Fine adjustment of the depth the screws are to be driven can be obtained by loosening the set screw and screwing the housing 130 into, or out of, the drive strap 22 and then fixing this adjustment by re-tightening the set screws against the housing 130.

The embodiment shown and described above is only exemplary. We do not claim to have invented all the parts, elements or steps described. Various modifications can be made in the construction, material, arrangement, and operation, and still be within the scope of our invention.

The restrictive description and drawings of the specific examples above do not point out what an infringement of this patent would be, but are to enable one skilled in the art to make and use the invention. The limits of the invention and the bounds of the patent protection are measured by and defined in the following claims.

We claim as our invention:

1. The method of attaching a work piece to a support comprising:

a) placing a work piece against the support, b) placing a screw gun having a flat planar face with the flat planar face against the work piece, c) pressing the flat planar face of the screw gun against the work piece, feeding a screw within the screw gun to a screw holder which is a part of the sc responsive to said pressing the planar work face against the work piece, e) then separating and independently of the pressing the screw gun against the work piece, engaging the screw with a rotating driver bit, f) guiding the rotating driver by a guide which is a part of the screw gun, and g) continuing to rotate the driver bit to drive the screw through the work piece and into the support.

2. The method as defined in claim 1 further comprising:

h) holding the screw normal to the planar work face and therefore normal to the surface of the work piece before the engagement of the bit with the screw.

3. A screw gun comprising:

a) a base having
   i) a drive end,
   ii) a feed end,
   iii) a length extending from end to end,
   iv) a handle face,
   v) a planar work face,
   vi) said faces opposing each other, and
   vii) a guideway between the faces, b) a handle on the base extending away from the handle face, c) said guideway forming at least a portion of structure adapted to hold a plurality of screws with heads in the base, with
   i) the heads of the screws proximate the handle face, and
   ii) the screws transverse to the planar work face, d) a bit guide attached to the base proximate the drive end of the base, e) a bit guided by said guide normal to the planar work face, f) a screw holder attached to the base aligned with the bit guide adapted to hold a screw, g) a carrier mounted on the base for movement in a direction aligned with the guideway, h) a pawl mounted on the carrier adapted to engage and advance a screw toward the screw holder, j) a spring on the base biasing the carrier away from the screw holder, k) an activator mounted for movement toward and away from the work face, and l) mechanism connecting the activator and carrier which moves the carrier toward the screw holder when the activator is forced toward the work face.

4. The screw gun as defined in claim 3 further comprising:

m) the activator is mounted within the base for reciprocal motion transverse of the planar work face.

5. The screw gun as defined in claim 3 further comprising:
m) said pawl mounted for movement toward and away from the carrier,
n) a spring between the pawl and carrier for biasing the pawl away from the carrier.

6. The screw gun as defined in claim 3 wherein said mechanism connecting the activator and carrier includes
m) a bell crank driven by said activator,
n) said bell crank pivoted to the base, and
o) a pitman connecting the bell crank to the carrier.

7. The screw gun as defined in claim 3 wherein said screw holder comprises:
m) a pair of spring clips,
n) said spring clips having concave bend within them,
o) said bends forming a cavity between them,
p) said cavity is aligned with the bit guide.

8. The screw gun as defined in claim 3 wherein said handle is attached to the feed end of the base and connects to the bit guide.

9. The screw gun as defined in claim 3 further comprising:
m) a driver strap attached to the handle face of the base,
n) said bit guide including a tube having a distal end with external threads threaded into
o) a threaded hole in said driver strap,
p) a bearing telescoped in the top of said tube,
q) said bit telescoped through said bearing,
r) a handle sleeve telescoped around the top of said tube attached to said handle,
s) at least one set screw extending through said handle sleeve to releaseably hold said handle sleeve in fixed position to said tube, and
t) a spring clip attached into said bit beyond the distal end of said tube.

10. A screw gun in combination with a plurality of screws, each having a head and a point, attached to a strip and also in combination with a magazine, comprising:
a) a base having
  i) a drive end,
  ii) a feed end,
  iii) a length extending from end to end,
  iv) a handle face,
  v) a planar work face,
  vi) said faces opposing each other, and
  vii) a guideway between the faces,
b) a handle on the base extending away from the handle faces,
c) said guideways having planar surfaces on each side thereof,
d) a longitudinal groove in each planar surface extending the length of the screw gun,
e) said guideway forming at least a portion of structure holding said plurality of screws in the base, with
  i) the heads of the screws proximate the handle face, and
  ii) the points of the screw near the work face,
  iii) each screw having a mid-point between the head and the point,
  iv) the screws transverse to the planar work face,
g) a plurality of bodies on the strip, each of the bodies around the approximate middle of one of the screws,
h) a knob on each of the bodies extending to either side thereof fit within the groove of the guideway,
j) a thin, narrow, strip extending from each body to the body in front thereof, thereby connecting the bodies,
k) a bit guide attached to the base proximate the drive end of the base,
l) said guide adapted to guide a bit normal to the planar work face,
m) said bit having a positive drive head thereon, and
n) the head of each of the screws having positively driven splines therein,
o) a screw holder attached to the base aligned with the bit guide, having
  i) a pair of spring clips,
  ii) said spring clips having concave bends within them,
  iii) said bends forming a cavity between them, and
  iv) said cavity is aligned with the bit guide,
p) a carrier mounted on the base for movement in a direction aligned with the guideway,
q) a pawl mounted on the carrier adapted to engage and advance a screw toward the screw holder,
r) said pawl mounted for movement toward and away from the carrier,
s) a spring between the pawl and carrier for biasing the pawl away from the carrier,
t) an activator in the form of a cylindrical plunger extending through the base and the planar work face,
u) a bell crank pivoted to the base,
v) said activator drivingly connected to said bell crank,
w) a spring for pressing said activator outward from the work face,
x) a pitman connecting the bell crank to the carrier,
y) so constructed and arranged so that forcing the actuator toward the work face moves the carrier toward the drive end and the movement of the actuator away from the work face by spring pressure retracts the carrier,
z) said magazine for loading screws into the guideway,
aa) said magazine including a box having a rectangular portion with two sides,
bb) said strip placed in a "Z"-fold in the rectangular portion of the box,
cc) said magazine including a neck,
dd) said neck attached to the screw gun at the feed end thereof,
ee) a magazine guideway in the neck forming means for guiding said screws on the strips along the magazine guideway,
ff) said magazine guideway aligned with the guideway in the screw gun, and
gg) said magazine including a feed section connecting the box to the neck,
hh) said feed section having a concave wall on one side of the magazine with bevel means for guiding the heads of the screws and a convex wall on the other side of the magazine with bevel means for guiding the heads of the screws.

11. A screw gun in combination with
a) a plurality of screws,
b) each screw with a head thereon, attached to
c) a flexible strip, said strip holding the screws aligned and parallel,
wherein the improvement comprises:
d) a base having
  i) a drive end,
  ii) a feed end,
  iii) a length extending from end to end,
  iv) a handle face,
  v) a planar work face,
  vi) said faces opposing each other, and
  vii) a guideway between the faces, e) a handle on the base extending away from the handle face, f) said guideway forming at least a portion of structure holding to said plurality of screws on said strip in the base, with i) the heads of the screws proximate the handle face, and ii) the screws transverse to the planar work face, g) a bit guide attached to the base proximate the drive end of the base, h) a bit guided by said guide normal to the planar work face, j) a screw holder attached to the base aligned with the bit guide holding one of said screws, k) a carrier mounted on the base for movement in a direction aligned with the guideway, l) a pawl mounted on the carrier to engage and advance said screws toward the screw holder, m) a spring on the base biasing the carrier away from the screw holder, n) an activator mounted for movement toward and away from the work face, and o) mechanism connecting the activator and carrier which moves the carrier toward the screw holder when the activator is forced toward the work face.

12. The screw gun in combination with the plurality of screws and flexible strip as defined in claim 11 wherein p) said bit has a positive drive head thereon, and q) the heads of the screws have positively driven splines therein.

13. The screw gun in combination with a plurality of screws attached to the strip as defined in claim 11 in combination with a magazine for loading screws into the guideway comprising:

p) a box having a rectangular portion with two sides, q) said strip placed in a "Z" fold in the rectangular portion of the box, r) said magazine including a neck, s) said neck attached to the screw gun at the feed and thereof, t) a magazine guideway in the neck forming means for guiding said screws on the strip along the magazine guideway, u) said magazine guideway aligned with the guideway in the screw gun, and v) said magazine including a feed section connecting the box to the neck.

14. The screw gun in combination with the plurality of screws attached to the strip as defined in claim 11, further comprising:

p) said strip having a plurality of bodies, each body attached to one of the screws, q) each of said screws having a point on the end opposite the head, r) each of said bodies located about half-way between the head and the point of the screw, s) each of said bodies having i) a connecting link connecting one body to the next body and ii) two sides, t) the sides of the body being half-way between the connecting links, u) said sides having knobs v) each knob having a distal portion, w) the distance from the distal knob on one side to the distal knob on the other side greater than the width of the guideway.

15. The screw gun in combination with the plurality of screws attached to the strip as defined in claim 14 further comprising:

x) said guideway having a groove on each side thereof, y) said knobs riding in said grooves for positioning thereof.

16. A magazine adapted to attach into a screw gun, in combination with a strip, said strip having a plurality of parallel screws attached thereto, each of said screws having a head and a point, wherein the improvement comprises:

a) a box having a rectangular portion with two sides, b) said strip placed in a "Z" fold in the rectangular portion of the box, c) a neck on the magazine whereby the magazine may be attached to a screw gun, d) a magazine guideway in the neck forming a means for guiding said screws on the strip along the guideway, e) said guideway including a bevel means for guiding the heads of the screw, and f) a feed section connecting the box to the guideway.

17. The magazine in combination with the strip with screws as defined in claim 16 wherein said feed section comprises:

g) a concave wall on one side of the magazine with h) a bevel means for guiding the heads of the screws and i) a convex wall on the other side of the magazine with j) a bevel means for guiding the heads of the screws.

18. The magazine in combination with the strip with screws as defined in claim 17 further in combination with structure comprising:

k) an elongated loading tab attached to and extending from the strip through the neck, l) said loading tab attached to the strip at the concave wall when the magazine is full.

* * * * *